US006526243B2

(12) United States Patent
Kim et al.

(10) Patent No.: US 6,526,243 B2
(45) Date of Patent: Feb. 25, 2003

(54) DEVELOPING UNIT-TONER CARTRIDGE ASSEMBLY OF IMAGE FORMING APPARATUS

(75) Inventors: Kyung-Hwan Kim, Yongin (KR); Ki-Ju Pak, Yongin (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/964,376

(22) Filed: Sep. 28, 2001

(65) Prior Publication Data

US 2002/0085857 A1 Jul. 4, 2002

(30) Foreign Application Priority Data

Dec. 29, 2000 (KR) ..... 2000-86390

(51) Int. Cl.[7] ..... G03G 15/08; G03G 21/00
(52) U.S. Cl. ..... 399/119; 399/113; 399/359
(58) Field of Search ..... 399/119, 120, 399/113, 258, 262, 359; 222/DIG. 1

(56) References Cited

U.S. PATENT DOCUMENTS 5,506,665 A * 4/1996 Ishida et al. ..... 399/119 X
5,614,996 A * 3/1997 Tanda ..... 399/120 X
6,041,212 A * 3/2000 Okada ..... 399/359
6,289,194 B1 * 9/2001 Endo et al. ..... 399/113 X

FOREIGN PATENT DOCUMENTS

JP 06-035321 * 2/1994

* cited by examiner

*Primary Examiner*—Sophia S. Chen
(74) *Attorney, Agent, or Firm*—Robert E. Bushnell, Esq.

(57) ABSTRACT

In an image forming apparatus, a developing unit includes an inlet cover for opening and closing a toner inlet formed in an outer casing of the developing unit, and an outlet cover for opening and closing a toner outlet. A toner cartridge includes a toner feeding roller for selectively opening and closing a toner feeding port formed in an outer casing of the toner cartridge, a recovery cover for opening and closing a toner recovery port formed in an outer casing of the toner cartridge in relative movement with the outlet cover during mounting and removal with respect to the developing unit, and a supporting projection for restricting and opening and closing one end of the inlet cover during mounting and removal of the toner cartridge with respect to the developing unit. As a result of this arrangement, a user does not have to perform additional steps to open and close the toner feeding path and the toner recovery path, and accordingly can use the image forming apparatus with more convenience.

8 Claims, 8 Drawing Sheets

DEVELOPING UNIT-TONER CARTRIDGE ASSEMBLY OF IMAGE FORMING APPARATUS

CLAIM OF PRIORITY

This application makes reference to, incorporates the same herein, and claims all benefits accruing under 35 U.S.C. §119 from my application DEVELOPING UNIT-TONER CARTRIDGE ASSEMBLY OF IMAGE FORMING APPARATUS filed with the Korean Industrial Property Office on Dec. 29, 2000 duly assigned Ser. No. 86390/2000.

BACKGROUND OF THE INVENTION

1. Field of the Invention

The present invention relates to an image forming apparatus such as a laser printer, a copier, or the like, and more particularly to a developing unit-toner cartridge assembly of an image forming apparatus in which toner feeding and recovering paths are opened and closed according to mounting and removal of a developing unit and a toner cartridge.

2. Description of the Related Art

Generally, an image forming apparatus performs a desired printing process in a computer network. A representative example can be taken from a laser printer, which, unlike dot printers or inkjet printers, uses an electro-photographic printing method. According to the electro-photographic printing method, an electrostatic latent image is formed when a laser beam is projected onto a photosensitive medium that is charged with electricity, and the electrostatic latent image is visualized by toner particles, and transferred and printed on a paper. The laser printer has a printer body housing an engine portion for forming an image, and a paper cassette for feeding the paper to the engine portion.

The engine portion has a developing unit, a Laser-beam Scanning Unit (LSU), and a fixing unit for fixing the toner image on the paper.

The developing unit has a photosensitive drum charged by a proper discharging method, such as a corona discharge. On the photosensitive drum, the electrostatic latent image is formed by the laser beam projected from the LSU. Further, the developing unit has a charging means for charging the photosensitive drum, a developing means such as a developing roller for conveying the toner from the developing unit to the photosensitive drum, and a cleaning means for cleaning waste toner remaining on the photosensitive drum.

The developing unit is connected, respectively, to a toner cartridge for feeding the toner into the developing unit, and a waste toner recovering device for collecting the waste toner after the printing process.

When the toner cartridge is connected to the developing unit, the toner cartridge is interconnected with the developing unit through a toner feeding path. Accordingly, the toner is fed from the toner cartridge to the developing unit. After being fed, the toner is attached onto the electrostatic latent image area formed on the photosensitive drum, and then transferred to the printing paper passing through the photosensitive drum. During this process, a small amount of toner is not transferred to the printing paper, but remains on the photosensitive drum. The remainder of the toner is removed by the cleaning means of the developing unit, and is recovered in a waste toner recovering device connected to the developing unit through a waste toner recovering path.

The toner feeding path from the toner cartridge to the developing unit, and the waste toner recovering path from the developing unit to the waste toner recovering device, are opened and closed by opening/closing members respectively mounted thereon.

More specifically, in the conventional combination of the developing unit and the waste toner recovering device, when the developing unit is separate from the waste toner recovering device, the waste toner recovering path is closed as a discharge port shutter closes a discharge port of the developing unit, while a receiving port shutter closes a receiving port of the toner recovering device. When the developing unit is connected to the waste toner recovering device, the discharge port shutter is aligned with the receiving port shutter. In such a situation, as a user manually rotates the receiving port shutter in a predetermined direction, the discharge port shutter is rotated by the rotation of the receiving port shutter, and accordingly, the waste toner recovering path is closed.

Further, in the event that the developing unit is improperly connected to the waste toner recovering device, the receiving port may remain in a closed state while the discharge port is opened by the rotation of the discharge port shutter. If the printing process is performed in such a state, the waste toner is not discharged properly, and accordingly, printing quality may deteriorate. Further, due to the presence of the waste toner, internal components of the printer can be contaminated.

SUMMARY OF THE INVENTION

The present invention has been made to overcome the above-mentioned problems of the related art, and accordingly, it is an object of the present invention to provide a developing unit-toner cartridge assembly of an image forming apparatus in which a toner feeding path and a toner recovering path are opened and closed by connection/separation of the developing unit and the toner cartridge.

The above object is accomplished by a developing unit-toner cartridge assembly for an image forming apparatus in accordance with the present invention, including: a developing unit mounted on an engine portion of a body of the image forming apparatus, the developing unit comprising an opening/closing member for opening and closing a toner inlet formed in an outer casing of the developing unit; and a toner cartridge removably mounted in the developing unit, the toner cartridge comprising first opening/closing means for opening and closing a toner feeding port formed in an outer casing of the toner cartridge, and second opening/closing means for restricting, and thereby opening and closing, the opening/closing member while the toner cartridge is mounted and removed to/from the developing unit.

The first opening/closing means includes: a toner feeding roller pivotally disposed within the toner cartridge, the toner feeding roller having a slit formed therein corresponding to the toner feeding port; and a pivotal handle formed on a leading end of a pivotal shaft of the toner feeding roller. The opening/closing member includes: an inlet cover slidably mounted on the outer casing of the developing casing for opening/closing the toner inlet; and a portion defining a locking hole on an upper surface of the inlet cover, through which hole the second opening/closing means is inserted for closing the inlet cover during removal of the developing unit from the toner cartridge. The second opening/closing means includes: a supporting projection protruding from the outer casing of the toner cartridge for supporting an end of the inlet cover by contact; and a stopper elastically disposed on the outer casing of the toner cartridge at a predetermined distance from the supporting projection, the stopper being inserted into or withdrawn from the locking hole.

The developing unit further includes an outlet cover for opening and closing a toner outlet formed in the outer casing of the developing unit, and the toner cartridge further comprises a recovery cover for opening/closing a toner recovery port formed in the outer casing of the toner cartridge so that, during the mounting and the removal of the toner cartridge with respect to the developing unit, the outlet cover and the recovery cover are restricted and, accordingly, opened and closed, respectively, by third opening/closing means formed on the toner cartridge and fourth opening/closing means formed on the developing unit, respectively.

The outlet cover is slidably connected to the outer casing of the developing unit for opening and closing the toner outlet, and has a first locking rise and a second locking rise protruding in a parallel manner from an upper surface of the outlet cover at a predetermined distance therebetween for contact with the third opening/closing means.

The third opening/closing means includes: a first hook elastically pivotable on the outer casing of the toner cartridge for restricting or releasing an inner side of the recovery port cover when the recovery port cover opens and closes the toner recovery port; a second hook opposed to the first hook on the cartridge casing for being pivoted in a relative movement with the first hook; and a third locking rise and a fourth locking rise formed on the cartridge case in a diagonally opposed manner with respect to each other across the recovery port cover. During the mounting and the removal of the toner cartridge with respect to the developing unit, the first and second hooks are pivoted by contact with the first and the second locking rises protruding from the outlet cover.

The fourth opening/closing means includes: a third hook elastically pivotable on the outer casing of the developing unit for restricting movement of the outlet cover by contacting with the locking projection; and a fourth hook elastically pivotable on the outer casing of the developing unit in such a manner as to be opposed to the third hook across the outlet cover, the first hook restricting the movement of the outlet cover by contacting with the locking hole formed on a side of the outlet cover, and the third and fourth hooks being pivoted by contact with the third and the fourth locking rises when the toner cartridge is mounted and removed with respect to the developing unit.

As described above, according to the present invention constructed as above, since the toner feeding path and the toner recovering path are opened and closed by relative operation of the developing unit and the toner cartridge during mounting and removal of the toner cartridge with respect to the developing unit, the user does not have to perform separate jobs in order to open and close the toner feeding path and the toner recovering path.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference numerals indicate the same or similar components, and wherein.

DETAILED DESCRIPTION OF THE PREFERRED EMBODIMENT

Figure 1:
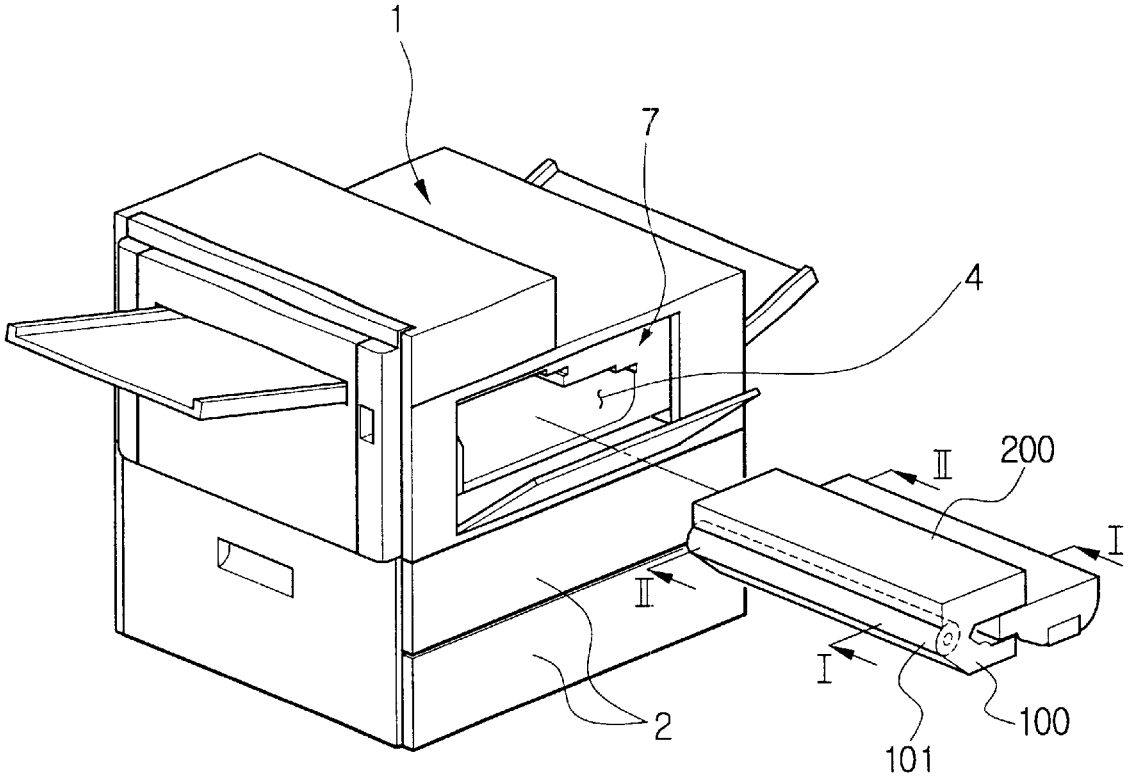
FIG. 1 is a schematic perspective view separately showing a main portion of a laser printer in accordance with the present invention.

This invention will be described in further detail by way of example with reference to the attached drawings. Throughout the description, like elements will be given the same reference numerals, while repetitious description will be omitted as possible.

As shown in FIG. 1, a laser printer of the present invention includes a controller portion (not shown) formed in a printer body 1, an engine portion 4 also formed in the printer body 1 for forming an image under the control of the controller portion, and paper cassettes 2 for feeding paper to the engine portion 4.

The engine portion 4 includes a developing unit 100, a toner cartridge 200 removably disposed on the developing unit 100 for feeding toner, and a fixing unit (not shown) for fixing toner image on the paper.

The developing unit 100 has a photosensitive drum 101 on which an electrostatic latent image corresponding to a desired image is formed by a laser beam projected from the laser beam scanning unit (LSU) 7 which is charged with electricity by a proper method, such as corona discharge or the like. Although not described in detail, the developing unit 100 of the present invention also includes a charging means for charging the photosensitive drum 101 with a certain amount of electricity, a developing means such as a developing roller for transferring the toner from the developing unit 100 to the photosensitive drum 101, and a cleaning means for removing residual waste toner from the photosensitive drum 101.

The unique feature of the developing unit-toner cartridge assembly in accordance with the preferred embodiment of the present invention is that the toner cartridge is integrally formed with the waste toner recovering device, divided into a fresh toner chamber for holding fresh toner, and a waste toner chamber for holding the waste toner recovered after it is used in the developing unit.

Figure 2:
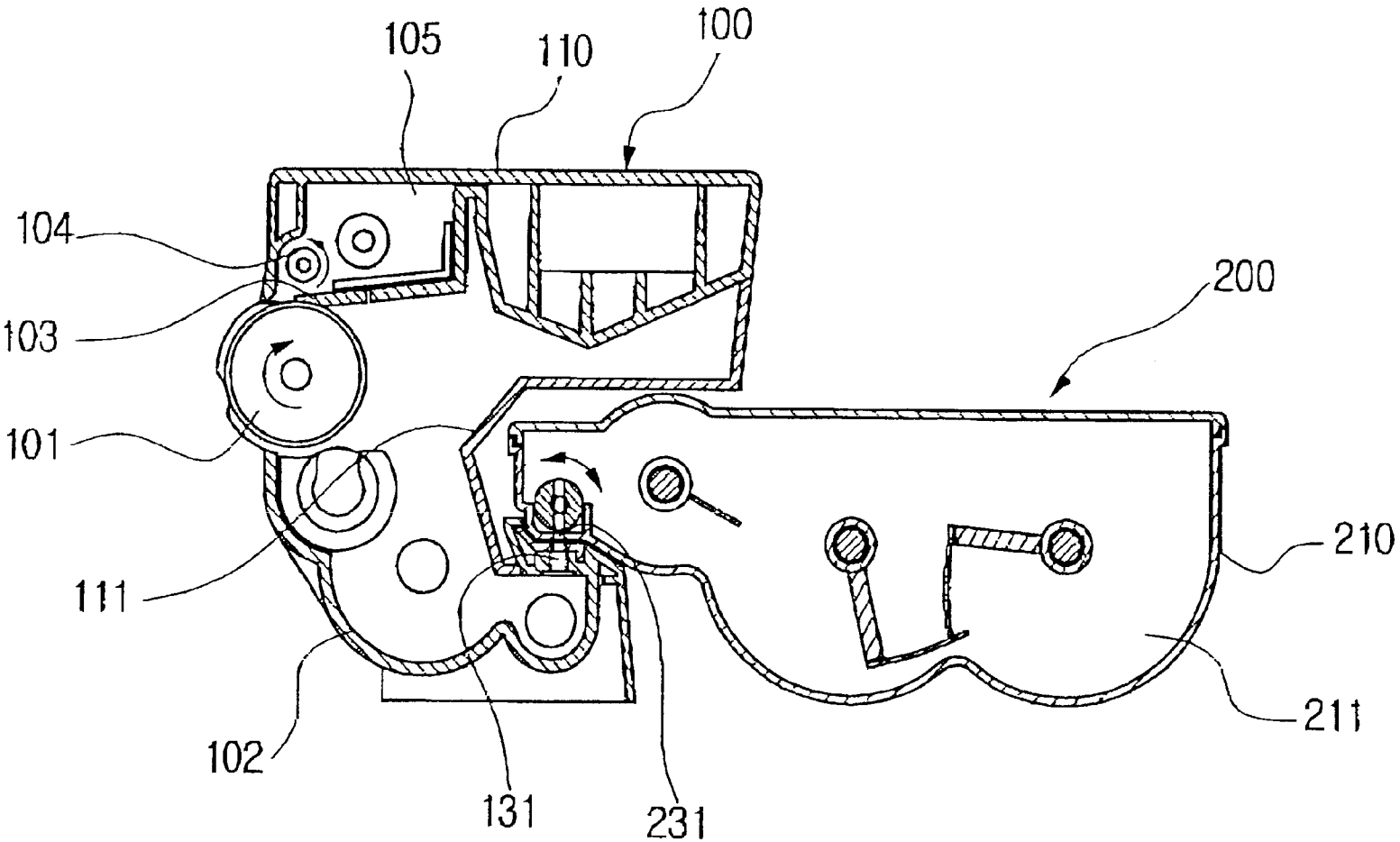
FIG. 2 is a traverse sectional view schematically showing the developing unit-toner cartridge assembly of the image forming apparatus in accordance with the present invention.
Figure 3:
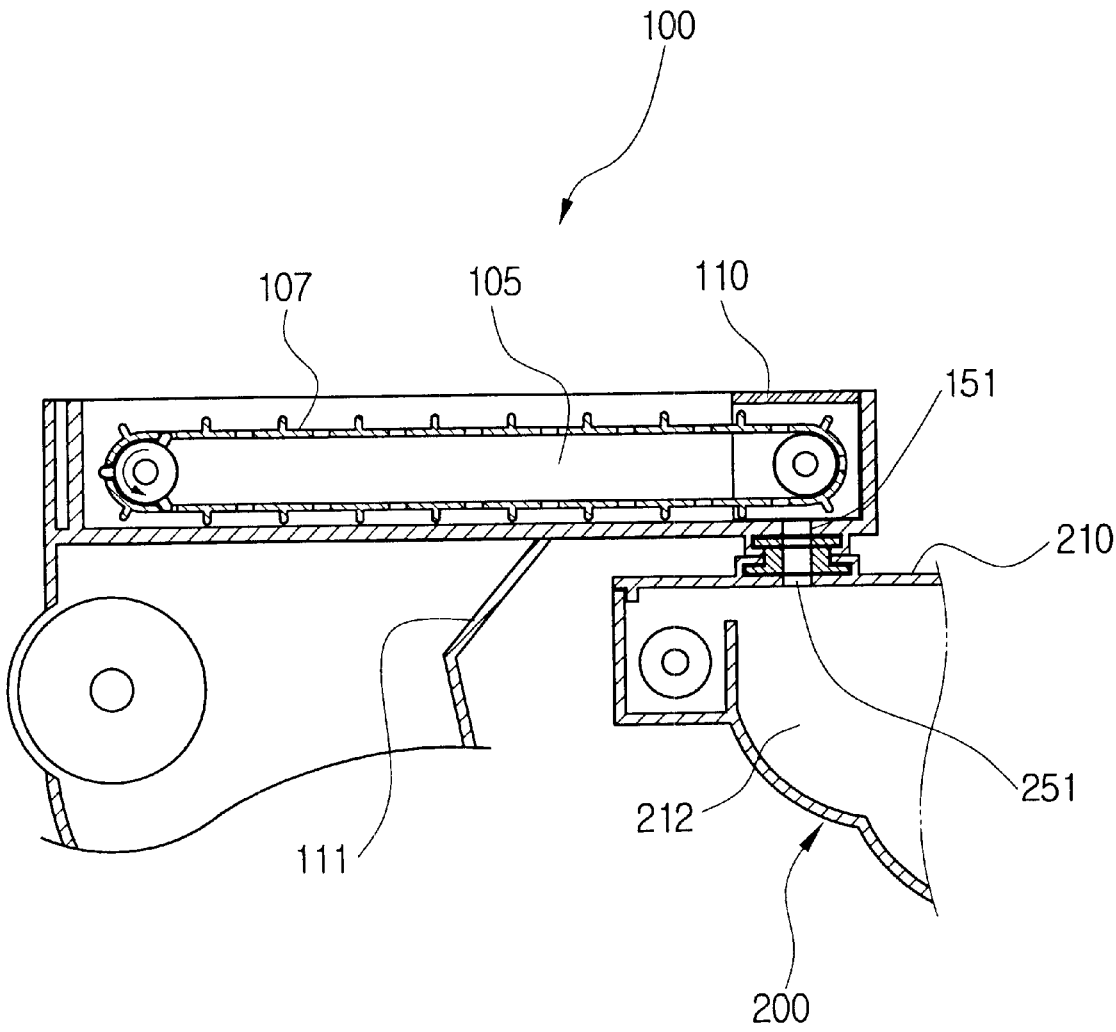
FIG. 3 is a traverse sectional view schematically showing the developing unit-toner cartridge assembly of the image forming apparatus in accordance with the present invention.

FIGS. 2 and 3 are traverse sectional views for schematically showing the developing unit-toner cartridge assembly of the image forming apparatus in accordance with the present invention, in which FIG. 2 is a sectional view taken along line I—I of FIG. 1, while FIG. 3 is a sectional view taken along line II—II of FIG. 1.

As shown in FIGS. 2 and 3, the toner cartridge 200 includes: a cartridge case 210 having a fresh toner chamber 211 holding fresh toner, and a waste toner chamber 212 holding waste toner that is left after being used in the developing unit 100; a toner feeding port 231 through which the fresh toner is fed from the fresh toner chamber 211 to the developing unit 100; and a toner recovery port 251 through which the waste toner is recovered from the developing unit 100 into the waste toner chamber 212.

The developing unit 100 includes a developing unit case 110 having a channel portion 111 formed thereon and connected with the toner cartridge 200, a toner inlet 131 interconnected with the toner feeding port 231 and serving as the feeding path of the fresh toner, and a toner outlet 151 interconnected with the toner recovery port 251 and serving as the recovery path of the waste toner.

The toner feeding port 231 is formed on the upper surface of the cartridge case 210, while the toner recovery port 251 is formed on the lower surface of the cartridge case 210. The toner inlet 131 and the toner outlet 151 are formed on the lower and upper surfaces, respectively, of the channel portion 111 of the developing unit case 110 in such a manner as to interconnect with the toner feeding portion 231 and the toner recovery port 251, respectively.

The reference numeral 101 of FIG. 2 indicates a photosensitive drum, and reference numeral 102 indicates a developer agitating chamber. The fresh toner in the fresh toner chamber 211 of the cartridge case 210 is fed into the developer agitating chamber 102 of the developing unit 100 through the toner feeding port 231 and the toner inlet 131. The fresh toner is then transferred onto the electric latent image area on the photosensitive drum 101, and onto the paper. During the transfer, the toner partially remains on the surface of the photosensitive drum 101. Such remaining toner is removed by a blade 103 and is conveyed into the waste recovery chamber 105 by a recovery roller 104.

The reference numeral 107 of FIG. 3 refers to a conveyor belt. Accordingly, the waste toner of the waste toner recovery chamber 105 is conveyed toward the toner outlet 151 by the conveyor belt 107, and is stored in the waste toner chamber 212 of the toner cartridge 200 through the toner recovery port 251.

Meanwhile, the developing unit 100 has an opening/closing member for selectively opening and closing the toner inlet 131, while the toner cartridge 200 includes a first opening/closing means for selectively opening and closing the toner feeding port 231, and a second opening/closing means for selectively opening and closing the opening/closing member according to whether the developing unit 100 is mounted or removed.

Figure 4A:
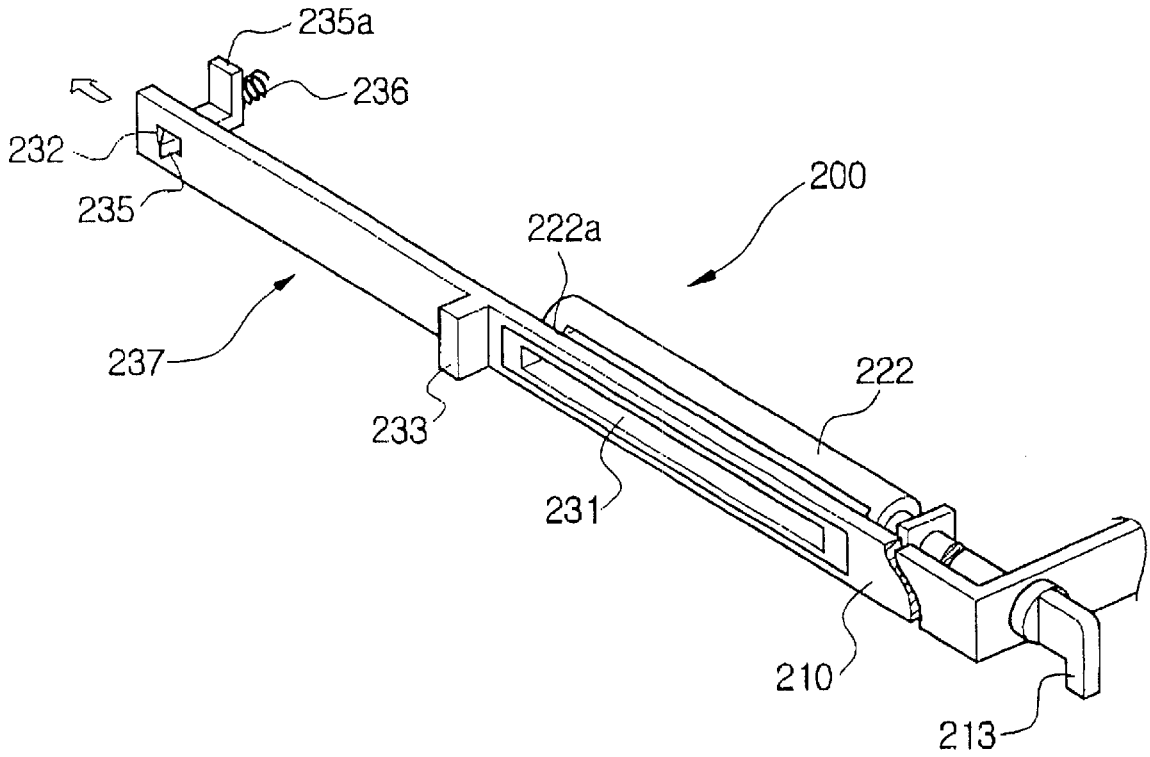
FIGS. 4A and 4B are perspective views separately showing the main portion of the present invention, i.e., the developing unit-toner cartridge assembly of the image forming apparatus in accordance with the present invention.
Figure 4B:
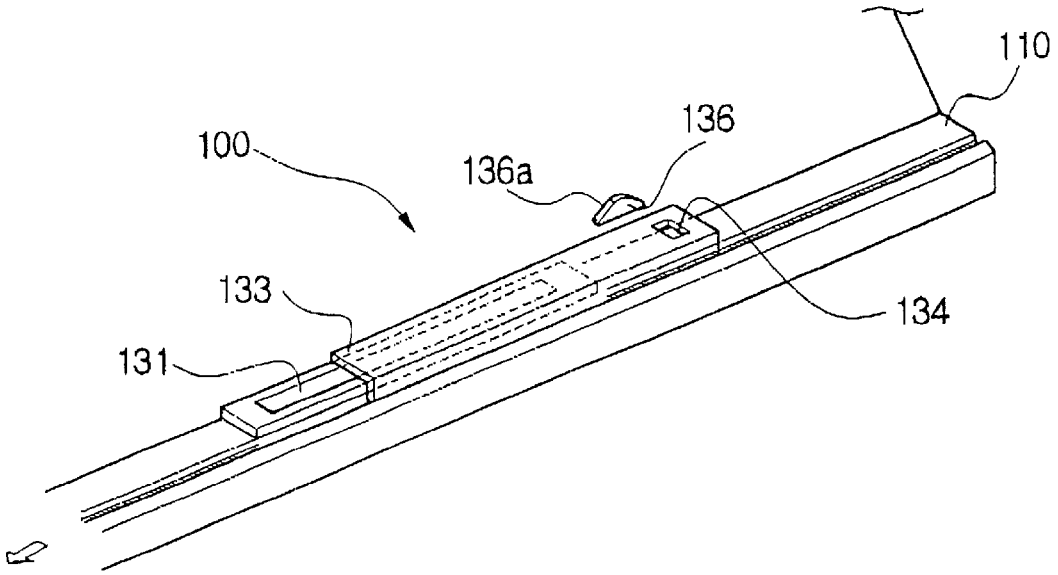

FIGS. 4A and 4B are perspective views separately showing the main portion of the present invention, i.e., the developing unit-toner cartridge assembly of the image forming apparatus in accordance with the preferred embodiment of the present invention. FIG. 4A shows the area where the toner feeding port 231 of the toner cartridge 200 is formed, while FIG. 4B shows the area where the toner inlet 131 of the developing unit 100 is formed.

As shown in FIG. 4A, the first opening/closing means includes a toner feeding roller 222 pivotally disposed within the fresh toner chamber 211 of the cartridge case 210 in close contact with the toner feeding port 231, and a pivotal handle 213 pivotally formed on the outer portion of the cartridge case 210 in connection with a pivotal shaft of the toner feeding roller 222. The toner feeding roller 222 has a rectangular opening 222*a* formed therein and corresponding to the toner feeding port 231 to permit the fresh toner from the fresh toner chamber 211 to pass therethrough. Accordingly, by pivoting the pivotal handle 213, the toner feeding roller 222 is pivoted to selectively interconnect the toner feeding port 231 and the rectangular opening 222*a*.

Meanwhile, the second opening/closing means includes a supporting projection 233 protruding outward from the cartridge case 210, an inserting hole 232 formed in the cartridge case 210 at a predetermined distance from the supporting projection 233, and a stopper 235 for elastic insertion into locking hole 134 (see FIG. 4B) of developing unit 100 through the inserting hole 232. One end of the stopper 235 is connected to a spring 236 for biasing the stopper 235 toward the locking hole 134, and a guide segment 235*a* protrudes from the side of the stopper 235. The reference numeral 237 refers to a contact surface with an inlet cover 133 (see FIG. 4B) which will be described later.

As shown in FIG. 4B, the opening/closing member includes the inlet cover 133 sidably disposed on the developing unit case 110 for opening and closing the toner inlet 131, and the locking hole 134 formed on the upper surface of the inlet cover 133 and corresponding to the inserting hole 232 of the toner cartridge 200. Meanwhile, the developing unit case 110 has a guide projection 136 having an inclined surface 136*a* and formed at a predetermined distance from the upper portion of the inlet cover 133. The guide projection 136 guides the guide segment 235*a* of the stopper 235 during the mounting and removal of the developing unit 100 and the toner cartridge 200.

Figure 5A:
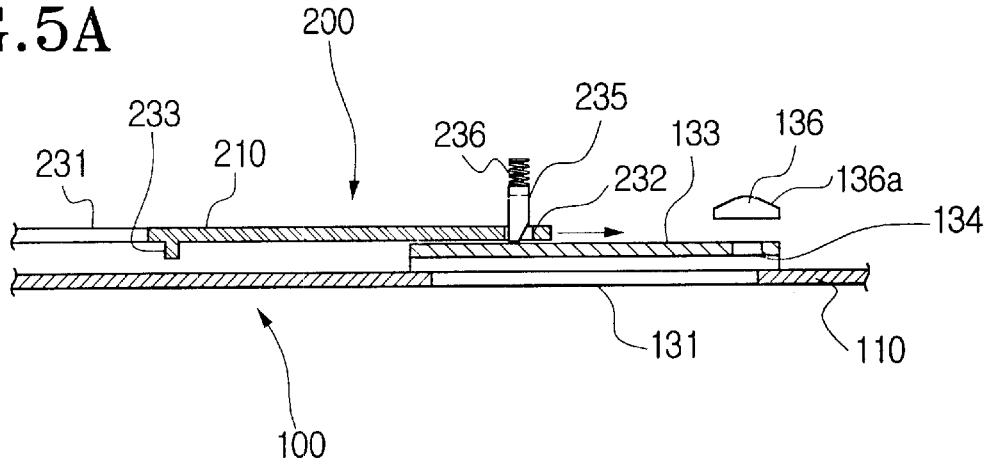
FIGS. 5A thru 5C are longitudinal sectional views partially showing the developing unit-toner cartridge assembly of the image forming apparatus in accordance with the present invention.
Figure 5B:
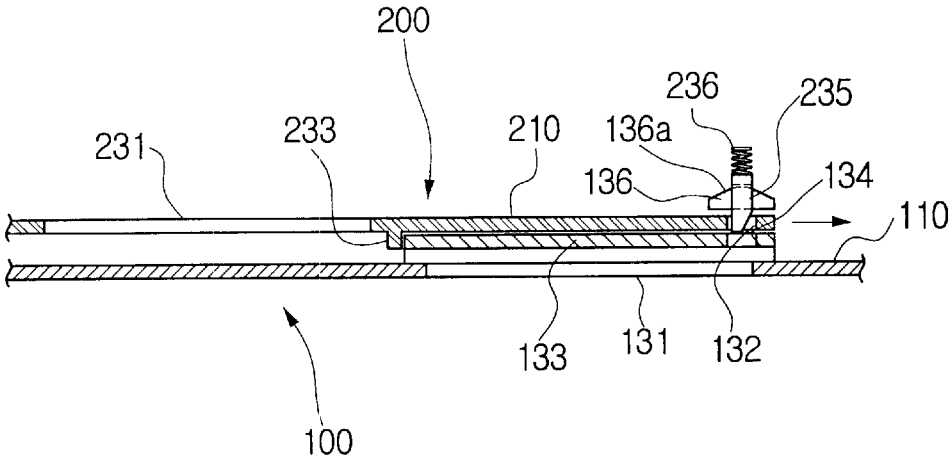
Figure 5C:
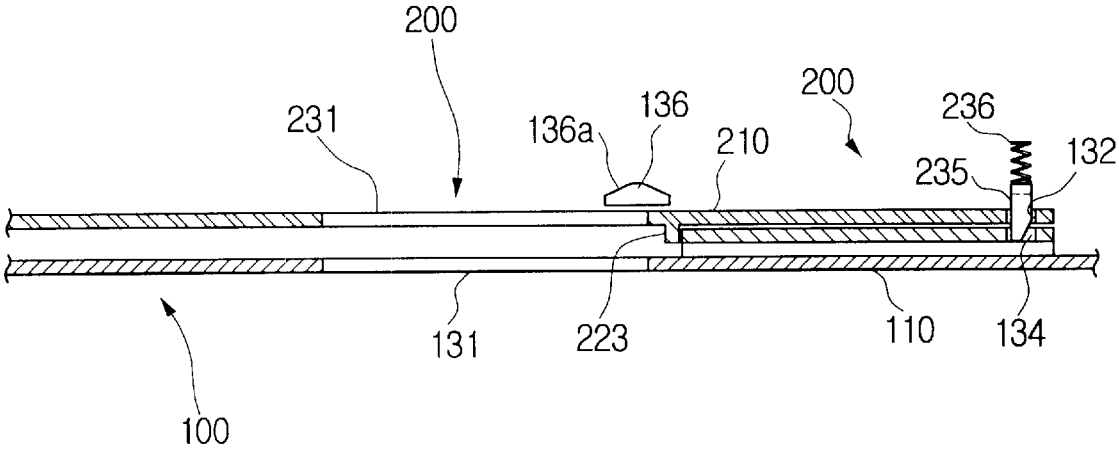

FIGS. 5A thru 5C are longitudinal sectional views for explaining the opening and closing of the toner inlet 131 during the mounting and removal of the developing unit 100 and the toner cartridge 200.

First, as shown in FIG. 5A, in a state wherein the developing unit 100 is mounted in the printer body 1, the toner cartridge 200 is pushed into the channel portion 111 of the developing unit 100. Accordingly, in a state wherein the contact surface 237 of the cartridge case 210 stays in contact with the inlet cover 133 of the developing unit 100, the toner cartridge 200 is pushed into the printer body 1; in other words, the toner cartridge 200 is pushed in a right-hand direction in FIG. 5A. The stopper 235 is pushed into the inserting hole 232, and the spring 236 is compressed.

Next, when the toner cartridge 200 is pushed into the printer body 1, as shown in FIG. 5B, the supporting projection 233 comes into contact with one end of the inlet cover 133 which is moved in response to the movement of the toner cartridge 200 to open the toner inlet 131.

FIG. 5C shows the toner cartridge 200 completely mounted in the printer body 1. As shown in FIG. 5C, the toner feeding port 231 and the toner inlet 131 are interconnected with each other, and the stopper 235 is inserted in the locking hole 134. A user pivots the pivotal handle 213, and accordingly, the rectangular opening 222*a* of the toner feeding roller 222 is interconnected with the toner feeding port 231.

In a reverse order, the toner cartridge 200 is separated from the developing unit 100. That is, in the state shown in FIG. 5C, the toner cartridge 200 is pulled out; in other words, the toner cartridge 200 is pulled in a left-hand direction of FIG. 5C. Accordingly, since the inlet cover 133 is restricted by the stopper 235 inserted in the locking hole 134, it is moved in relation to the toner cartridge 200. As shown in FIG. 5B, when the inlet cover 133 keeps moving relation to the toner feeding port 231, the guide segment 235*a* of the stopper 235 is moved along the inclined surface 136*a* of the guide projection 136, and the stopper 235 is accordingly released from the locking hole 134. Accordingly, the movement of the inlet cover 133 is stopped, and the toner cartridge 200 is exclusively separated from the printer body 1.

Figure 6A:
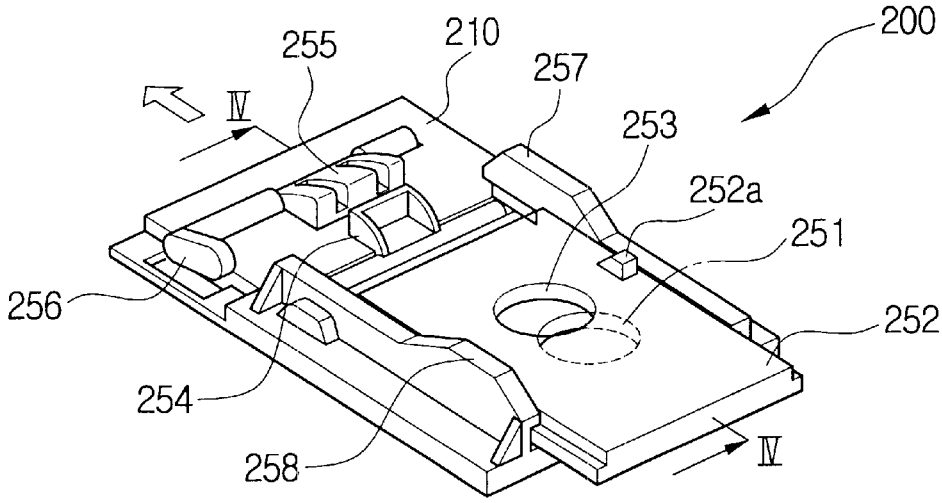
FIGS. 6A and 6B are perspective views separately showing the main portion of the present invention, i.e., the developing unit-toner cartridge assembly of the image forming apparatus in accordance with the present invention.
Figure 6B:
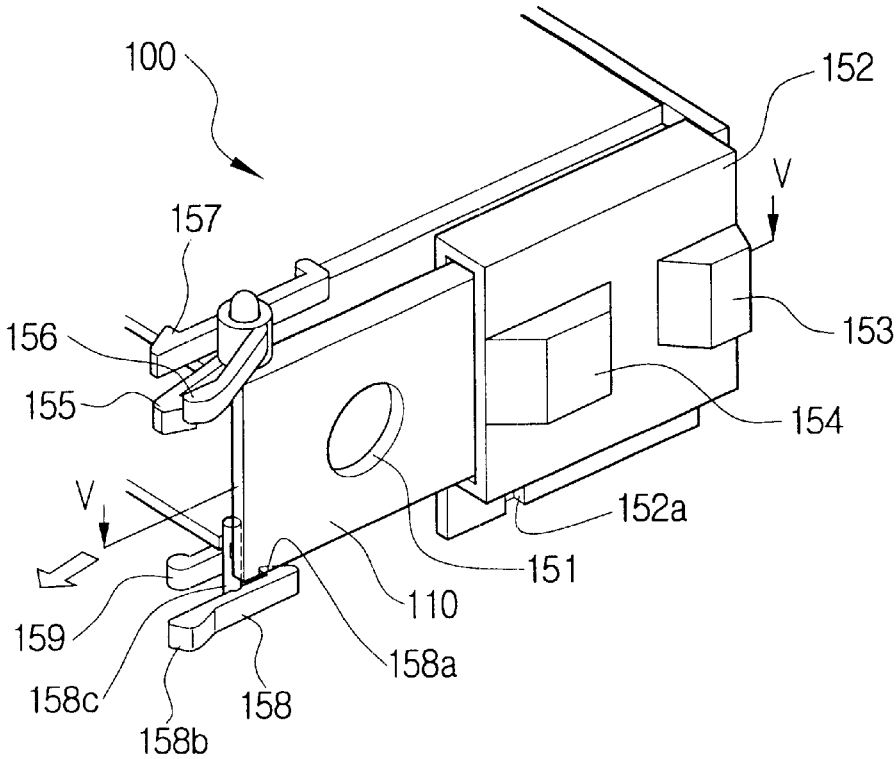

FIGS. 6A and 6B are perspective views of the developing unit-toner cartridge assembly of the image forming apparatus in accordance with the preferred embodiment of the present invention, in which FIG. 6A shows the area where the toner recovery port 251 of the toner cartridge 200 is formed, and FIG. 6B shows the area where the toner outlet 151 of the developing unit 100 is formed.

As shown in FIGS. 6A and 6B, the developing unit 100 includes an outlet cover 152 for selectively opening and closing the toner outlet 151, while the toner cartridge 200 includes a recovery port cover 252 for selectively opening and closing the toner recovery port 251. During the mounting and removal of the toner cartridge 200 and the developing unit 100, the outlet cover 152 and the recovery port cover 252 are restricted by a third opening/closing means formed on the toner cartridge 200 and a fourth opening/closing means formed on the developing unit 100, respectively, and are accordingly opened and closed.

As shown in FIG. 6A, the recovery port cover 252 is slidably mounted on the cartridge case 210 so as to open and close the toner recovery port 251. The recovery port cover 252 has a hooking projection 252*a* formed on its upper surface for being selectively hooked with a third hook (see FIG. 6B). Further, it is preferable that the recovery port cover 252 have a secondary recovery port 253 which is interconnected with the toner recovery port 251 when the recovery cover 252 is open.

Meanwhile, the third opening/closing means of the toner cartridge 200 includes first and second hooks 254 and 255, respectively and third and fourth locking rises 257 and 258, respectively.

Figure 7A:
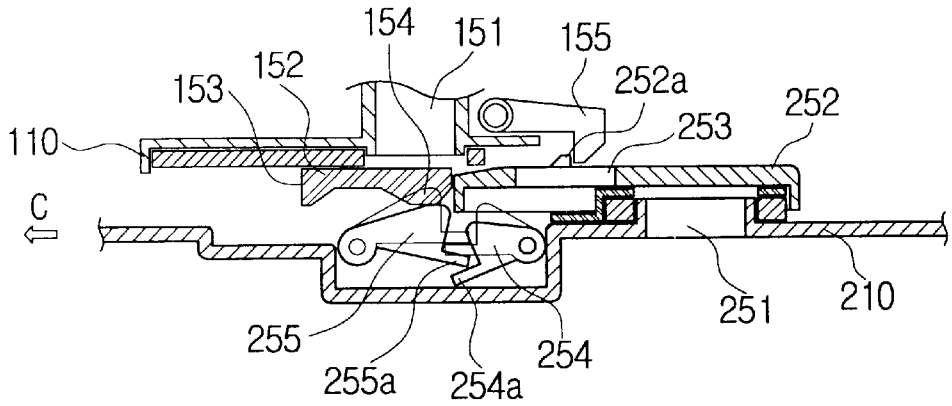
FIGS. 7A thru 7C are longitudinal sectional views partially showing the developing unit-toner cartridge assembly of the image forming apparatus in accordance with the present invention.
Figure 7B:
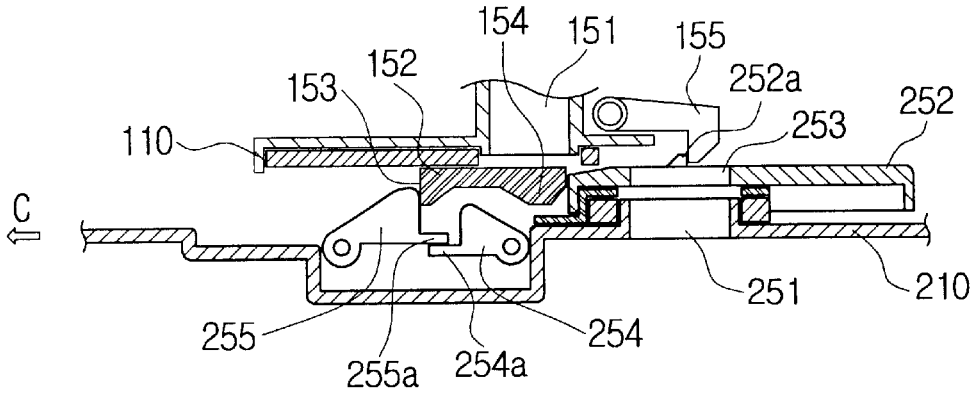

The first hook 254 is pivotally formed on the cartridge case 210 for restricting and releasing one inner end of the recovery port cover 252 while the recovery port cover 252 opens and closes the toner recovery port 251. One end of a pivotal shaft of the first hook 254 is connected with a torsion spring (not shown), which biases the first hook 254 toward the recovery port cover 252. The second hook 255 is formed on the cartridge case 210 in such a manner as to correspond to the first hook 254 and to be pivoted in relation to the first hook 254. A pivotal shaft of the second hook 255 is connected with a first lever 256. As shown in FIGS. 7A and 7B, the first and the second hooks 254 and 255, respectively, are arranged above an extension 254*a* of the first hook 254 in such a manner as to overlap an extension 255*a* for relative movement.

The first and the second hooks 254 and 255, respectively, contact first and second locking rises 153 and 154 (described later), respectively, formed on the outlet cover 152 (FIG. 6B) and pivot in relation to the first and the second locking rises 153 and 154, respectively, during the mounting and removal of the toner cartridge 200 and the developing unit 100.

The third and the fourth locking rises 257 and 258, respectively, are diagonally opposed relative to each other on opposite sides of the cartridge case 210 contacting the recovery port cover 252 for pivoting a second lever 156 of FIG. 6B and the fourth hook 158 by contact.

As shown in FIG. 6B, the outlet cover 152 is slidably connected with the developing unit case 110 for selectively opening and closing the toner outlet 151. The first and second locking rises 153 and 154, respectively, protrude in parallel to the upper surface of the outlet cover 152 at a predetermined distance therebetween. The outlet cover 152 also has a hooking groove 152*a* formed thereon, through which a fourth hook 158 is hooked.

Meanwhile, the fourth opening/closing means of the developing unit 200 includes the third and fourth hooks 155 and 158, respectively. The third hook 155 is pivotally disposed on the developing unit case 151, and is hooked in the hooking projection 252*a* formed on the upper surface of the recovery port cover 252, thereby restricting the movement of the recovery port cover 252. It is preferable that the second lever 156 extend toward the recovery port cover 252 and be connected with the pivotal shaft of the third hook 155 when the developing unit 100 is connected with the toner cartridge 200. The second lever 156 is pivoted upward and downward by contact with the third locking rise 257, thereby pivoting the third hook 155 upward and downward. Meanwhile, the pivotal shaft of the third hook 155 is connected with a first elastic member 157 for biasing the third hook 155 toward the recovery port cover 252. The fourth hook 158 is elastically pivotable on the developing unit case 110 while being opposed to the third hook 155 across the outlet cover 152. The fourth hook 158 is hooked in the hooking groove 152*a*, thereby restricting the movement of the outlet cover 152. From the standpoint of the pivotal shaft 158*c* of the fourth hook 158, a hooking portion 158*a* is formed on one end of the fourth hook 158 for being received in the hooking groove 152*a*, while a guide portion 158*b* protrudes from another end of the fourth hook 158. During the mounting and removal of the toner cartridge 200 and the developing unit 100, the guide portion 158*b* moves in contact with the fourth locking rise 258, and accordingly, the fourth hook 158 is pivoted upward and downward. Meanwhile, it is preferable that a second elastic member 159 be connected to the pivotal shaft 158*c* of the fourth hook 158, and that it bias the fourth hook 158 in such a direction that the hooking portion 158*a* is hooked with the hooking groove 152*a*.

Figure 7C:
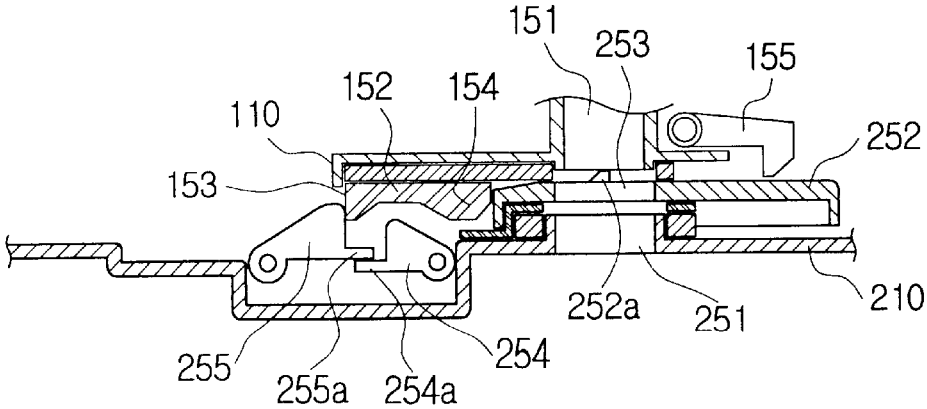
Figure 8A:
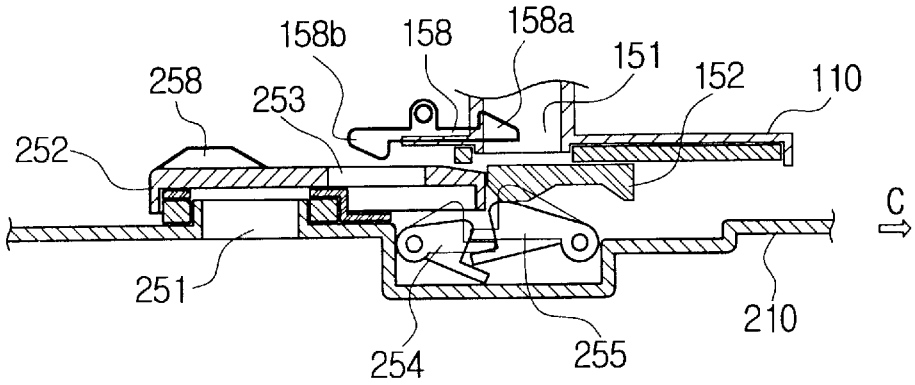
FIGS. 8A thru 8C are longitudinal sectional views partially showing the developing unit-toner cartridge assembly of the image forming apparatus in accordance with the present invention.
Figure 8B:
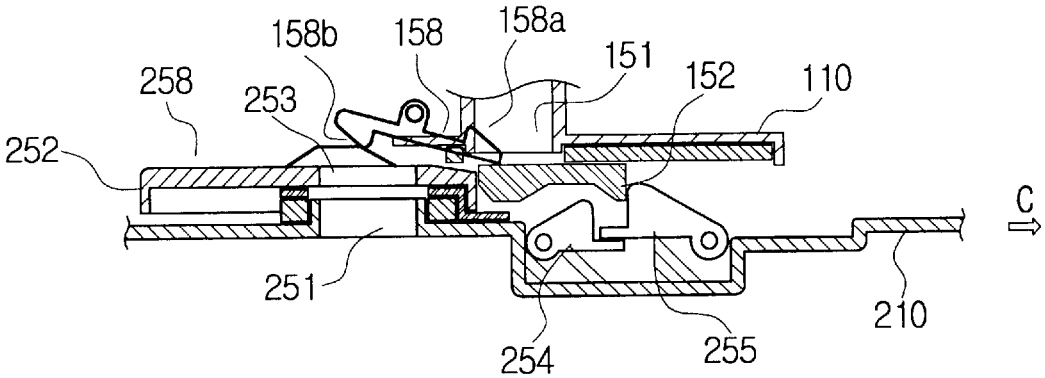
Figure 8C:
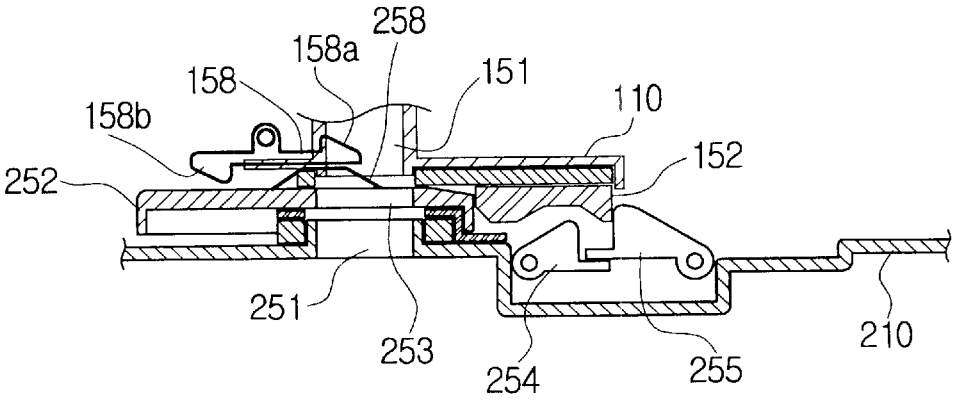

FIGS. 7A thru 7C and 8A thru 8C are longitudinal sectional views for explaining the opening and closing of the toner recovery port 251 land the toner outlet 151 during the mounting and removal of the developing unit 100 and the toner cartridge 200. Specifically, FIGS. 7A thru 7C are sectional views taken on lines IV—IV of FIG. 6A, and FIGS. 8A thru 8C are sectional views taken on line IV—IV in the opposite direction. That is, FIGS. 8A thru 8C are sectional views taken on line V—V of FIG. 6B.

First, as shown in FIG. 7A, in a state where the developing unit 100 is mounted in the printer body 1, the toner cartridge 200 is inserted in the channel portion 111 of the developing unit 100 (see FIG. 3). Accordingly, an end of the recovery port cover 252 comes into contact with an end of the outlet cover 152. At this time, the second hook 255 comes into contact with the second locking rise 154, and is pivoted in a downward direction in FIG. 7A. Also, the first hook 254 is moved in relation to the second hook 255, and is pivoted downward. As a result, the recovery port cover 252 is released from locking status by the first hook 254. Meanwhile, as shown in FIG. 8A, the outlet cover 152 is restricted by the hooking portion 158*a* of the fourth hook 158 inserted in the hooking groove 152*a*.

In the state shown in FIGS. 7A and 8A, when the toner cartridge 200 is kept pushing in the direction indicated by an arrow 'C', the cartridge case 210 is exclusively moved in the direction 'C' while the recovery port cover 252 is restricted at both ends by the outlet cover 152 and the second hook 255 (FIG. 7B). Accordingly, the toner recovery port 251 is interconnected with the secondary recovery port 253 (FIG. 8B). During the above process, as shown in FIG. 8B, since the guide portion 158*b* of the fourth hook 158 is slid along the fourth locking rise 258, the outlet cover 152 is released from the locking state by the fourth hook 158.

When the outlet cover 152 is released, the outlet cover 152 is moved in the direction 'C' according to the movement of the cartridge case 210. As a result, as shown in FIGS. 7C and 8C, the toner outlet 151, secondary recovery port 253, and toner recovery port 251 are interconnected with each other.

Meanwhile, the toner cartridge 200 is separated from the developing unit 100 in a reverse order. That is, the toner cartridge 200 is pulled out from the printer body 1 in the right-hand direction of FIG. 8C (the reverse of direction 'C'), and the outlet cover 152 is moved in the right-hand direction in relation to the cartridge case 210, while the outlet cover 152 is restricted by the second hook 255. Accordingly, the toner outlet 151 is closed.

Here, as shown in FIG. 7B, the third hook 155 is hooked in the hooking projection 252*a* of the outlet cover 252, and accordingly, the recovery port cover 252 and the outlet cover 152 are restricted. In such a state, as the user presses the first lever 256, while continuously pulling the toner cartridge 200, the cartridge case 210 is exclusively moved in the right-hand direction. Accordingly, as shown in FIG. 7A the toner recovery port 251 is closed by the recovery port cover 252.

Meanwhile, although not shown, if the toner cartridge 200 is continuously pulled from the state shown in FIG. 7A, the second lever 156 comes into contact with the third locking rise 257, pivoting the third hook to a releasing direction relative to the locking state with the hooking projection 252*a*. As a result, the toner cartridge 200 is completely removed from the developing unit 100.

As described above, according to the developing unit-toner cartridge assembly of the present invention, during the mounting and removal of the toner cartridge 200 with respect to the developing unit 100, the toner feeding path and the toner recovery path are opened and closed by the relative movement of the developing unit 100 and the toner cartridge 200. Accordingly, the user has convenience in handling, since he/she does not have to perform additional steps to open and close the toner feeding path and the toner recovery path.

Further, according to the present invention, since the toner feeding path and the toner recovery path are opened only when the developing unit 100 and the toner cartridge 200 are properly assembled with each other, print quality deterioration under inefficient toner supply and recovery, as well as interior contamination of the printer body 1 by the toner leakage, can be prevented.

Although the preferred embodiment of the present invention has been described, it will be understood by those skilled in the art that the present invention should not be limited to the described preferred embodiment, but various changes and modifications can be made within the spirit and scope of the present invention as defined by the appended claims.

What is claimed is:

1. A developing unit-toner cartridge assembly for an image forming apparatus, comprising:

a developing unit having an outer casing in which a toner inlet is formed, the developing unit being mounted on an engine portion of a body of the image forming apparatus and comprising an opening/closing member, including an inlet cover, for opening and closing the toner inlet formed in the outer casing of the developing unit; and a toner cartridge having an outer casing in which a toner feeding port is formed, the toner cartridge being removably mounted in the developing unit and comprising:

first opening/closing means for opening and closing the toner feeding port formed in the outer casing of the toner cartridge, wherein said first opening/closing means comprises a toner feeding roller pivotally disposed within the toner cartridge and corresponding to the toner feeding port, said toner feeding roller having a pivotal shaft and a slit formed therein, and wherein the first opening/closing means further comprises a pivotal handle formed on a leading end of the pivotal shaft of the toner feeding roller for opening and closing the toner feeding port formed in the outer casing of the toner cartridge; and second opening/closing means for restricting, and thereby opening and closing, the opening/closing member while the toner cartridge is mounted to and removed from the developing unit, wherein said second opening/closing means comprises a supporting projection protruding from the outer casing of the toner cartridge for supporting an end of the inlet cover by contact therewith, and a stopper elastically disposed on the outer casing of the toner cartridge at a predetermined distance from the supporting projection, the stopper being selectively inserted into and withdrawn from a locking hole for restricting, and thereby opening and closing, the opening/closing member while the toner cartridge is mounted to and removed from the developing unit.

2. The developing unit-toner cartridge assembly of claim 1, wherein the inlet cover is slidably mounted on the outer casing of the developing unit for opening and closing the toner inlet; and wherein the opening/closing member further comprises a portion defining the locking hole on an upper surface of the inlet cover, the second opening/closing means being inserted through the locking hole for closing the inlet cover during removal of the developing unit from the toner cartridge.

3. The developing unit-toner cartridge assembly of claim 1, further comprising a spring connected to one end of the stopper for biasing the stopper toward the locking hole, and a guide segment protruding from a side of the stopper so that, when the guide segment is moved along an inclined surface of a guide projection formed on the outer casing of the developing unit, the stopper is selectively inserted into and withdrawn from the locking hole.

4. The developing unit-toner cartridge assembly of claim 1, wherein a toner outlet is formed in the outer casing of the developing unit and a toner recovery port is formed in the outer casing of the toner cartridge, and wherein the developing unit further comprises an outlet cover for opening and closing the toner outlet formed in the outer casing of the developing unit, and the toner cartridge further comprises a recovery cover for opening and closing the toner recovery port formed in the outer casing of the toner cartridge, so that, during mounting and removal of the toner cartridge with respect to the developing unit, the outlet cover and the recovery cover are selectively opened and closed;

said assembly further comprising third opening/closing means formed on the toner cartridge for selectively opening and closing the outer cover, wherein the outlet cover is slidably mounted on the outer casing of the developing unit for opening and closing the toner outlet, and wherein the outlet cover includes a first locking rise and a second locking rise protruding in parallel from an upper surface of the outlet cover, with a predetermined distance therebetween, for contact with the third opening/closing means; and said assembly further comprising fourth opening/closing means formed on the developing unit for selectively opening and closing the recovery cover, and wherein the recovery cover is slidably connected to the outer casing of the toner cartridge for opening and closing the toner recovery port, and has a locking projection formed on an upper surface of the recovery cover for being restricted by the fourth opening/closing means.

5. The developing unit-toner cartridge assembly of claim 4, wherein the recovery cover comprises a secondary recovery port interconnected with the toner recovery port when the recovery cover is open.

6. The developing unit-toner cartridge assembly of claim 4, wherein the third opening/closing means comprises:

a first hook having a pivotal shaft elastically pivotable on the outer casing of the toner cartridge for selectively restricting and releasing an inner side of the recovery port cover when the recovery port cover opens and closes the toner recovery port;

a second hook having a further pivotal shaft disposed opposite to the first hook on the outer casing of the toner cartridge for pivoting relative to the first hook; and a third locking rise and a fourth locking rise formed on the outer casing of the toner cartridge in diagonal opposition to each other across the recovery port cover; and a lever extending from the further pivotal shaft of the second hook;

wherein, during the mounting and the removal of the toner cartridge with respect to the developing unit, the first hook and the second hook are pivoted by contact with the first locking rise and the second locking rise protruding from the upper surface of the outlet cover.

7. The developing unit-toner cartridge assembly of claim 4, wherein the fourth opening/closing means comprises:

a hook elastically pivotable on the outer casing of the developing unit for selectively restricting movement of the outlet cover by contact with the locking projection; and an additional hook elastically pivotable on the outer casing of the developing unit so as to be opposed to the hook across the outlet cover, the additional hook restricting the movement of the outlet cover by contact with a locking hole formed on a side of the outlet cover; and wherein the hook and the additional hook are pivoted by contact with a third locking rise and a fourth locking rise when the toner cartridge is mounted and removed with respect to the developing unit.

8. The developing unit-toner cartridge assembly of claim 7, further comprising a lever extending from a pivotal shaft of the hook toward the third locking rise, the lever being pivoted upward and downward by contact with the third locking rise, and the hook being correspondingly pivoted upward and downward; and wherein the additional hook has a locking portion formed on a first end of a pivotal shaft of the additional hook and a guide portion protruding from a second end of the pivotal shaft of the additional hook so that the additional hook is pivoted upward and downward by contact with the fourth locking rise.

* * * * *